United States Patent [19]

Reichardt

[11] Patent Number: 4,676,565

[45] Date of Patent: Jun. 30, 1987

[54] CONNECTOR ADAPTED TO BE MOUNTED ON A SURFACE OF A PRINTED CIRCUIT BOARD

[75] Inventor: Manfred Reichardt, Weinsberg, Fed. Rep. of Germany

[73] Assignee: Allied Corporation, Morris Township, Morris County, N.J.

[21] Appl. No.: 782,673

[22] Filed: Oct. 1, 1985

[30] Foreign Application Priority Data

Oct. 12, 1984 [DE] Fed. Rep. of Germany ..... 3437526

[51] Int. Cl.[4] ..... H01R 9/09

[52] U.S. Cl. ..... 439/79; 439/83

[58] Field of Search ..... 339/17 LC, 17 LM, 17 L, 339/17 C, 176 M, 176 MP

[56] References Cited

U.S. PATENT DOCUMENTS

| | | | |
|---|---|---|---|
| 3,384,864 | 5/1968 | Schwartz | 339/176 MP |
| 3,864,000 | 2/1975 | Coller et al. | 339/17 LC |
| 4,418,972 | 12/1983 | Benasutti | 339/17 LM |
| 4,509,811 | 4/1985 | Amano et al. | 339/17 LC |

OTHER PUBLICATIONS

*Electronic Engineering,* Aug. 1984, p. 15.

*Primary Examiner*—Neil Abrams
*Attorney, Agent, or Firm*—Roger H. Criss

[57] ABSTRACT

A connector adapted to be surface-mounted on a circuit board is provided. The free ends (soldering ends) of the termination legs (contact legs) of the contacts are led out of the connector in a single-row manner. The soldering ends are preferably placed on the line of section of the two possible circuit board-mounting planes (perpendicular mounting and parallel mounting). For a three-row connector, the soldering ends are spaced with a third of the spacing "t". The same contacts and soldering ends may be used for the perpendicular mounting as well as the parallel mounting. The contacts may be of integral design or of a multi-part design. Due to the U-shaped design of the termination legs or the soldering ends present for one or more rows of contacts, both surfaces of the circuit board may be contacted.

10 Claims, 17 Drawing Figures

CONNECTOR ADAPTED TO BE MOUNTED ON A SURFACE OF A PRINTED CIRCUIT BOARD

BACKGROUND OF THE INVENTION

1. Field of the Invention

The invention relates to a surface mount connector.

Description of the Prior Art

Connectors having a plurality of rows of contacts and adapted to be mounted on circuit boards are already known. Each of the contacts of the plurality of contacts of said connectors comprises termination legs adapted for insertion into through-holes of the circuit board. After insertion, the legs are soldered to the appropriate terminals which are located at these places. This known method requires that through-holes be provided in the circuit board. In addition, it is necessary to make sure prior to the soldering operation that all termination legs axially extend through the holes. It should be noted that said holes as well as the solder eyes necessary for soldering require a large amount of space on the circuit board. Said known connectors can be mounted in parallel (parallel mounting) or perpendicularly to the circuit board (perpendicular mounting). For the parallel mounted connector the direction of mating extends parallel to the longitudinal axis of the circuit board, while for the perpendicular mounting the direction of mating extends perpendicularly to the longitudinal axis of the circuit board.

The insertion of the numerous contact or termination legs (presently up to 96 contact legs) into the through-holes of the circuit board can be quite complicated, and it has therefore already been suggested to provide solder terminals or solder pads on the circuit board for a connector of the parallel mounting type. As soon as a connector of this type is placed on the circuit board, the ends of the termination legs which are provided with flattened soldering ends, come into contact with said soldering pads. Inasmuch as the soldering pads for each line of contacts are placed behind each other, i.e. in the direction of the longitudinal axis of the circuit board, again a large amount of space is required on the circuit board. It is, moreover, not possible to lead the termination legs of a line of contacts, termination legs which are also placed behind each other, out of the connector in such a manner that also the lower surface of the circuit board can be contacted by said termination legs.

It would be desireable to provide a connector having a plurality of rows of contacts for mounting on a circuit board such that only a small amount of space on the circuit board is required and that no shadow effect will occur when wave soldering is used.

It would also be desireable to provide a connector in such a manner that it is equally useful for parallel as well as perpendicular mounting purposes on the circuit board.

In accordance with this invention, there is provided a connector adapted to be mounted on a printed circuit board, the connector comprising an insulating body, a plurality of contact elements arranged in a plurality of rows and a plurality of lines, termination legs, each of which being connected to each one of the contact elements, the termination legs lead out of the insulating body such that after placing the connector onto the printed board, the three ends of the termination legs terminate adjacent to the surface of the printed board close to solder pads which are provided at the surface, characterized in that for each line of contact elements, the termination arms extend out of the insulting body such that the free ends of the termination legs are arranged adjacent to each other on a line parallel to the longitudinal axis of the connector.

The free space which is required for the soldering operation is provided within the outline of the insulating body, so as to reduce the required space on the circuit board. Specifically, the free space is provided by the dome of the connector.

According to the invention the same connector can be used for parallel mounting as well as perpendicular mounting due to the fact that the ends of the termination legs end on a line which is defined by the section of a supporting surface (i.e. the surface which the connector is placed on the circuit board) and the bottom side of the connector.

BRIEF DESCRIPTION OF THE DRAWINGS

FIGS. 7–9 are views of another embodiment of the invention, with

FIG. 7 being a view of the connector in the direction of arrow I in FIG. 8, FIG. 8 being a cross-sectional view substantially along line F–G in FIG. 7 and FIG. 9 being a schematic view of two lines of male contacts seen in the direction of arrow H in FIG. 8;

DESCRIPTION OF THE PREFERRED EMBODIMENTS

Figures 1, 2, 3:
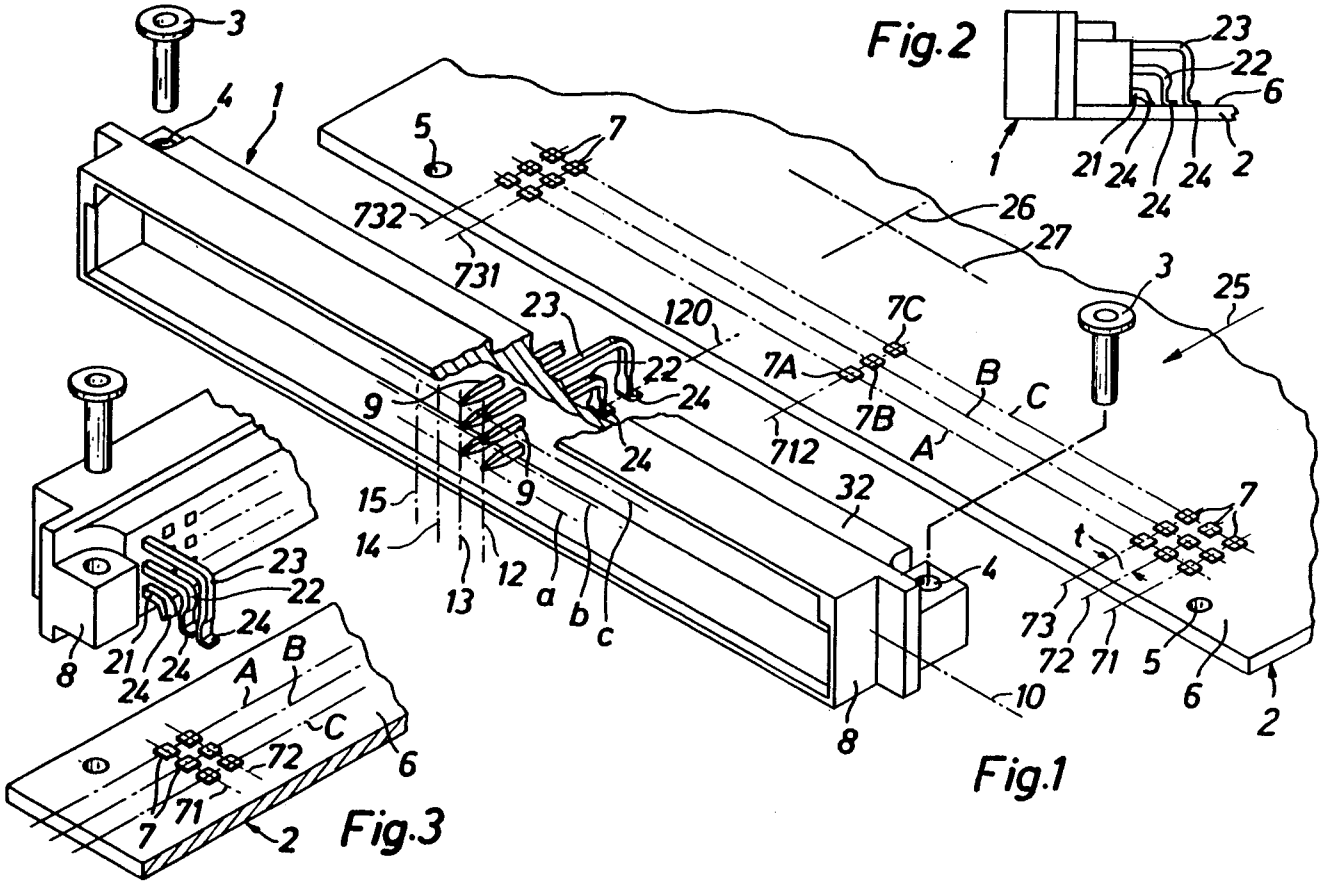
FIG. 1 is a perspective representation of a known connector together with its circuit board.
FIG. 2 is a side elevational view of the known connector of FIG. 1 placed on the circuit board.
FIG. 3 is a partial perspective view of the known connector seen in the direction of arrow 25 in FIG. 1.

FIGS. 1, 2, and 3 disclose a prior art connector 1 having a plurality of rows of contacts. Connector 1 can be mounted on a circuit board 2 by means of rivets 3. The rivets 3 extend through bores 4 in the connector 1 and bores 5 in the circuit board 2 when the connector 1 is placed on the circuit board 2. The connector 1 as shown in FIG. 2 is placed on the upper surface 6 of the circuit board 2 in a direction parallel to the direction of mating of the connector (this kind of mounting is called parallel mounting).

The connector 1 having a plurality of rows of contacts comprises an insulating body 8 in which a large number of termination contacts in the form of male contacts 9 is arranged. In the embodiment as shown three rows a, b and c of male contacts 9 are provided. The male contacts 9 are also placed in a plurality of parallel arrangements along the longitudinal axis 10 of said connector; said arrangements being designated as lines. If one starts the numbering of said lines in FIG. 1 at the right hand end of the connector, then the two shown lines of male contacts might be designated for example, line number 12 and line number 13. Two additional lines 14 and 15 are shown, however, without the male contacts. Altogether, for instance, 32 of such lines of contacts might be present.

The male contacts 9 extend out of the backside of the insulating body 8 by means of contact termination means (contact - or termination legs) 21, 22 and 23. Each of said contact legs is downwardly angled and ends in flattened soldering ends 24. The soldering ends 24 are located on a line 120. The line 120 extends perpendicularly to the appropriate line 12 of the male contacts. A line of the type of line 120 may be called a soldering end line (i.e. a line on which the soldering ends are located). The appropriate lines of male contacts and the appropriate soldering end lines are, however, located in the same plane. Provided that the connector 1 is placed on the upper surface or side 6 of the circuit board in a direction parallel to the direction of mating, then the lines 120 of the soldering ends 24 (just one line 120 is shown) will be in alignment with appropriate lines of soldering pads 7. The soldering pads 7 of the circuit board 2 are arranged not only in a plurality of rows, but also in a plurality of lines. The shown embodiment discloses three rows A, B, C and lines 71, 72, 73, as well as 712, 731 and 732 of soldering pads. For instance, the line 712 of soldering pads or termination means would cooperate with male contacts 9 in line 12 of connector 1. For lines 712 the individual soldering pads are designated 7A, 7B and 7C.

As mentioned, the longitudinal axis of the connector 1 carries the reference numeral 10 and the circuit board 2 comprises a longitudinal axis 26 and a transversal axis 27.

FIG. 3 is a schematic isometric partial view in the direction of arrow 25 in FIG. 1. One can clearly recognize in FIG. 3 that the termination legs 21, 22, 23 are placed in a plane which is defined by the appropriate contacts, e.g. male contacts 9, i.e. the termination legs are placed "behind each other" in a direction of the longitudinal axis 26 of the circuit board, an axis which is shown in FIG. 1. It can be said that in case of the prior art connector 1 the termination legs extend out of the connector 1 in a multi-row arrangement, because, in fact, the soldering ends 24 are supposed to be placed on the solder pads 7 which are arranged in a plurality of rows A, B, C. This kind of arrangement means a significant use of space for the connector 1 on the circuit board 6. This used room is lost for any other kind of use. Another disadvantage of the prior art design resides in the fact that the termination legs 21–23 cannot be used for contacting the bottom surface of the circuit board 2, because a short circuit situation would result. As already mentioned, the prior art design has the disadvantage that a so-called "shadow" is formed if the wave soldering technique is used; the multi-row arrangement of the solder pads would provide a shielding effect for the soldering wave because the solder pads are placed behind each other.

In FIG. 1 "t" refers to the spacing or the pitch for the arrangement of the solder pads 7 (and therefore also for the contacts of the connector).

In the following description of embodiments of the invention similar reference numerals will be used for components similar to the one just described.

Figure 4:
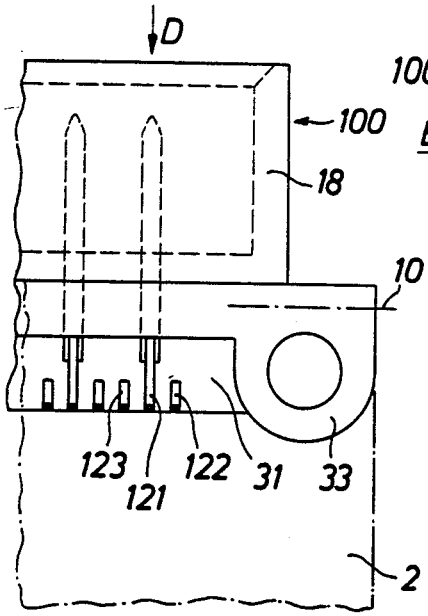
FIG. 4 is a schematic view in the direction of arrow E in FIG. 5 of a connector of the invention with the circuit board being shown partially and schematically.
Figure 5:
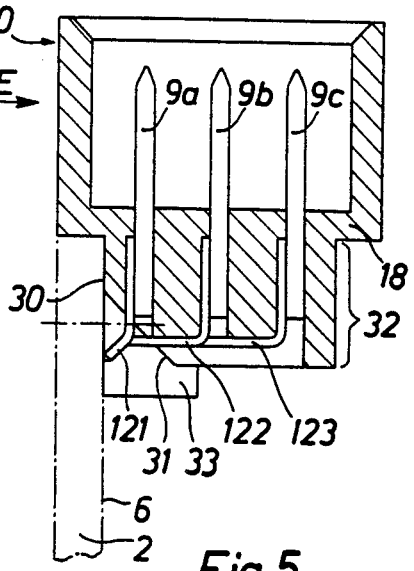
FIG. 5 is a cross-sectional view of the connector of FIG. 4 in substance along one line of contacts.
Figure 6:
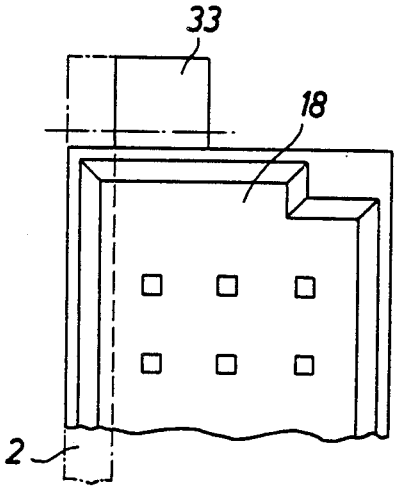
FIG. 6 is a plane view substantially in the direction of arrow D in FIG. 4.

A first embodiment of a multi-row connector 100 of the invention is shown in FIGS. 4 to 6. Connector 100 is adapted for "parallel mounting" at a circuit board 2 in a way similar to the prior art connector 1 of FIGS. 1–3. Connector 100 comprises an insulating body 18. The lower portion of insulating body 18 is called a connector dome 32. The insulating body 18, specifically the connector dome 32 defines a supporting surface 30, a surface adapted for engagement with the upper surface 6 of the circuit board 2. In accordance with the invention the supporting surface 30 does not extend along the entire height (or length) of the connector dome 32. In fact, the supporting surface 30 is angled beginning approximately in the middle of the connector dome 32, so as to form a slanting surface 31 in such a manner that between the insulating body 18 and the upper surface 6 of the circuit board 2 a free space is defined which is triangularly shaped in cross-section. The free space provides for an exit of the termination legs 121–123 which requires little space. It is to be recognized in FIG. 4 and in FIG. 5 that the conductor—or termination legs 121, 122, 123 of contacts **9*a*, 9*b* and 9*c* which are located in one line are not arranged behind each other as is true for the prior art shown in FIGS. 1 to 3, but end in substance adjacent to each other as is shown in FIG. 4. Therefore, the ends of the termination legs 121, 122, 123 are arranged on a line which extends parallel to the transversal axis 27 of the circuit board 2, i.e. parallel to the longitudinal axis 10 of the connector 100; said ends of the termination legs being intended for connection with the soldering pads 7 explained earlier but not shown in FIGS. 4 to 6** and also not in the following figures.

It should be noted that the insulating body 18 forms at its both ends a mounting member 33. The mounting member 33 comprises a bore, so as to allow the mounting of the connector 100 at the circuit board 2.

Figure 7:
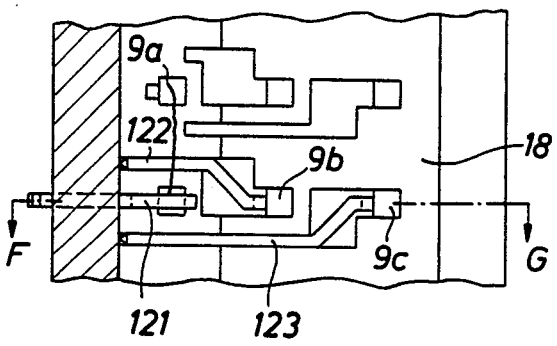
Figure 8:
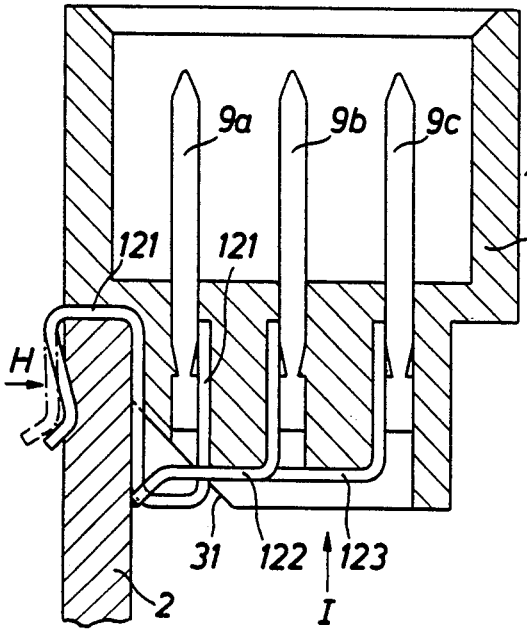
Figure 9:
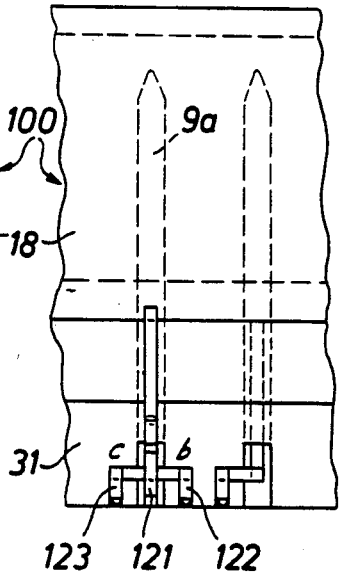

FIGS. 7 to 9 disclose another embodiment of the invention. For one of the termination legs, i.e. the leg 121 a special kind of termination technique is disclosed. Apart from this special termination technique the embodiment of FIGS. 7–9 corresponds to the first embodiment shown in FIGS. 4–5. Therefore, the following description of the embodiment of FIGS. 7–9 is also largely applicable to the embodiment of FIGS. 4–6.

Particularly FIG. 7 discloses quite clearly the manner in which the contacts **9*a*, 9*b* and 9*c* are led out of the insulating body 18 by means of the termination legs 121, 122 and 123 in such a manner that the ends of said termination legs 121–123 are placed adjacent to each other and parallel to the longitudinal axis 10 of the connector as well as parallel to the transverse axis 27 of the circuit board. It is shown that in accordance with the invention the contact 9*a* which is located next to the exit side of the connector is led out (of the insulating body 18) in a direct manner, while the next adjacent contact 9*b* bypasses contact 9a on one side, and contact 9c is led out (of the insulating body) by by-passing said contact 9b as well as contact 9a** on the other side.

The special design feature of the embodiment shown in FIG. 7–9 is disclosed specifically in FIG. 8. According to FIG. 8, contact 9a is brought into contact with the bottom surface of the circuit board 2. This is done by the termination leg 121 which is U-shaped and embraces the edge of the circuit board 2 and comes with its contacting end in engagement with the lower surface of the circuit board.

Figure 10:
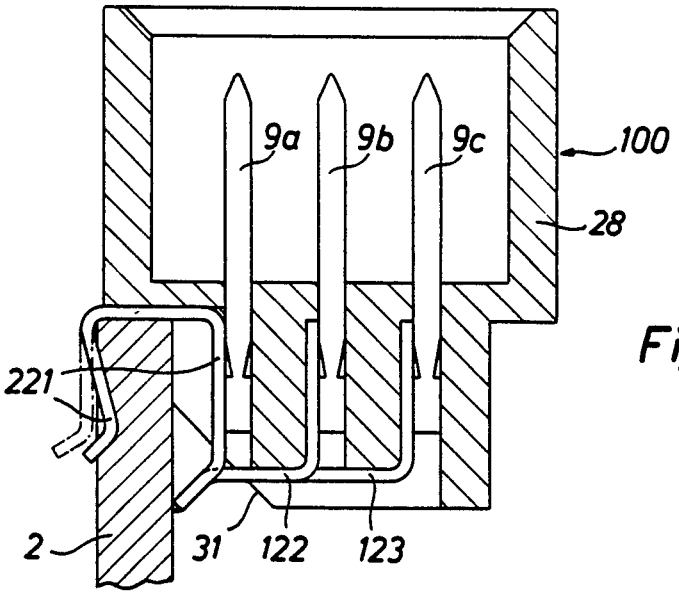
FIG. 10 is a view similar to the view shown in FIG. 8, but of a different design of one of the contact legs which is adapted for contacting the lower surface of the circuit board.

Another embodiment of the invention is shown in a cross-sectional view in FIG. 10. FIG. 10 shows another possibility for the design of a termination leg 221, a termination leg which is again intended for contacting the lower surface of the circuit board 2. According to FIG. 10, the termination leg 221 is of a simple U-shaped form intended for embracing the circuit board 2 with one of the U-legs being immediately mounted to the contact 9a. In contract thereto according to the design shown in FIG. 8, the termination leg 121 comprises two substantially U-shaped parts or legs.

Figure 11:
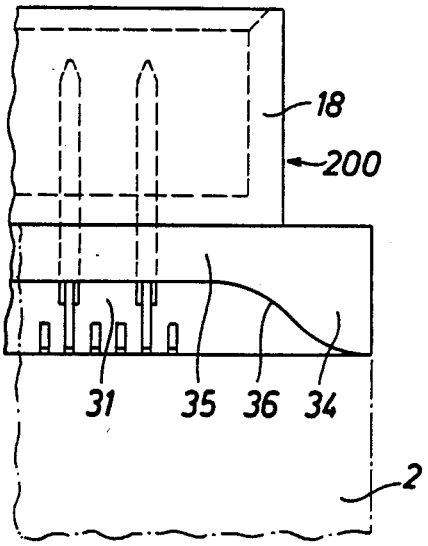
FIG. 11 is a view similar to the view of FIG. 4 and discloses another embodiment of the invention.

The three embodiments disclosed in FIGS. 4–5 and FIGS. 7–9 and FIG. 10 show contacts together with their appropriate termination legs as being of a two-part design. It should be noted that it is also possible to use a multiple-part design. It is further possible to provide for an integral design for each contact and the appropriate termination leg as will be shown in a different context in reference to FIGS. 15 and 16. FIG. 11 discloses another embodiment of the invention. The connector 200 of FIG. 11 differs from the embodiment of FIGS. 4–5 only insofar as the mounting members are provided in the form of enlargements 34, i.e., the mounting members are smaller and have a shape which is more favorable with respect to the flow of solder. The enlargements 34 are preferably provided for being mounted by means of an adhesive to the circuit board 2. If such an adhesive mounting approach is used, then the circuit board 2 would be placed on the surface where the line of reference numeral 34 ends and also on the narrower region 35 which is adjacent thereto. The curved sloped part adjacent to the enlargement 34 simplifies the access of the solder bath to the soldering ends of the termination legs.

The prior art connector shown in FIGS. 1–3 and the embodiments of the invention shown in FIGS. 4–5 and 7–9 and 10 and 11 disclose cases where the connector is mounted in parallel to the direction of mating (parallel mounting). In contrast thereto, in connection with the Figures yet to be described, embodiments will be discussed where the connector is mounted in accordance with the invention in a direction perpendicular to the direction of mating.

Figures 12, 13:
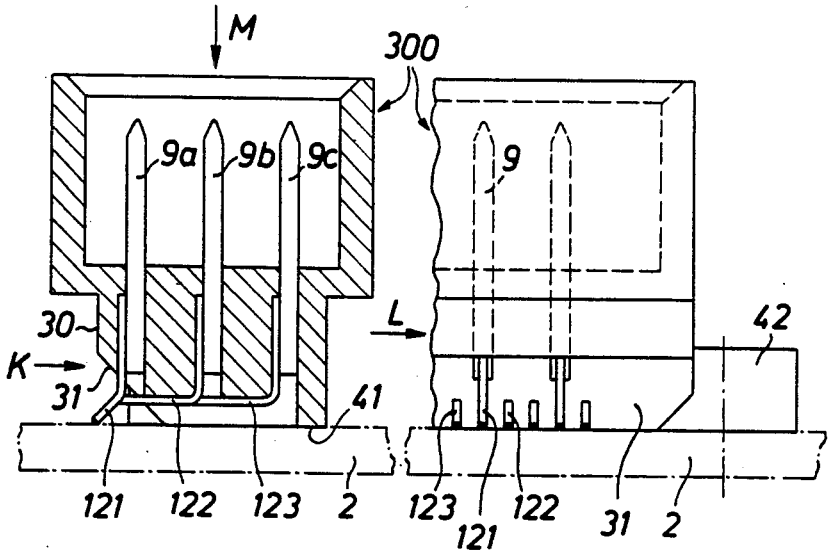
FIGS. 12, 13 and 14 are views of another embodiment of a connector which is mounted perpendicularly with respect to the circuit board with FIG. 12 being a schematic view in the direction of arrow K in FIG. 13, FIG. 13 being a cross-sectional view of one row of contacts, and FIG. 14 being a plane view substantially in a direction of arrow M in FIG. 13.
Figure 14:
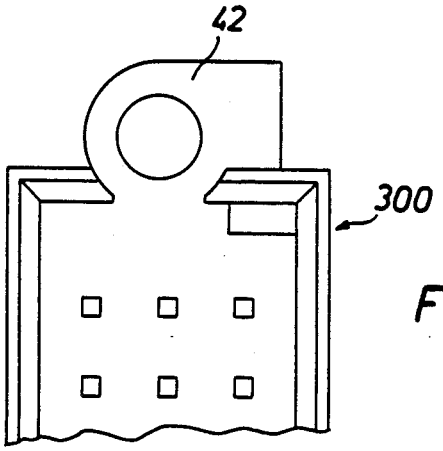

According to an embodiment of the invention shown in FIGS. 12–14, a connector 300 is located with its bottom side or bottom surface 41 on the upper surface of the circuit board. The connector 300 is provided with two mounting members 42 (only one is shown) by means of which connector 300 is fixed to the circuit board 2. FIG. 13 shows that contacts 9a, 9b and 9c which are located in one line are led out (of the connector 300 or insulating body) by means of termination legs 121, 122 and 123 in a manner similar to what is shown in FIG. 5. The ends of the termination legs 121, 122, 123 end or terminate preferably in a free space which is triangular in cross-section and which is defined by the slanting surface 31 which extends from the mounting surface 30 and extends toward the middle of the connector. The embodiments shown in FIGS. 4–6 and 13–14, respectively, are substantially identical in design, i.e., the connector 100 provided for parallel mounting can also be used as the connector 300 intended for perpendicular mounting, as long as appropriate mounting means are present, e.g., in the form of the mounting members 42.

Figure 15:
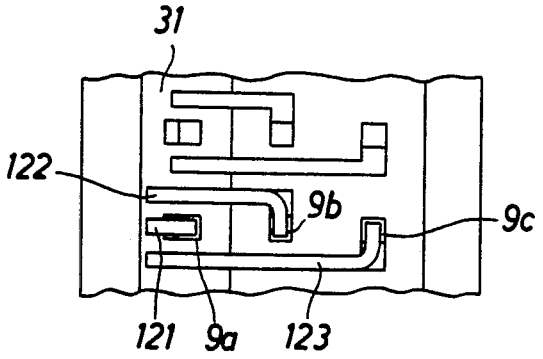
FIGS. 15 and 16 disclose another embodiment of a connector according to the invention and FIG. 17 discloses a still further embodiment of a connector adapted for perpendicular mounting and for contacting the bottom surface of the circuit board.
Figure 16:
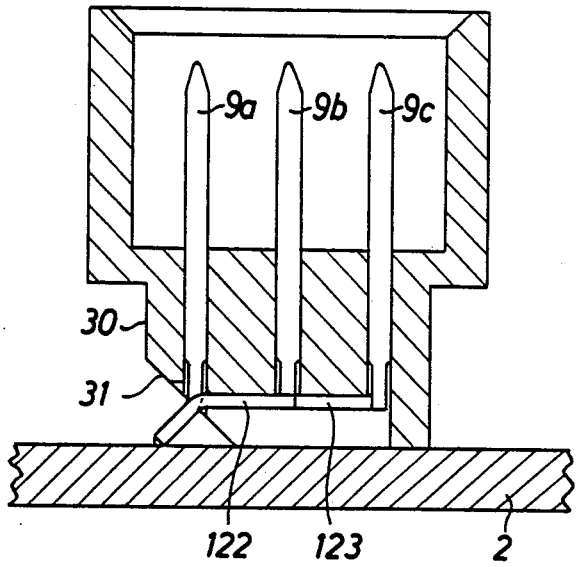

FIGS. 15 and 16 disclose an embodiment similar to the embodiment shown in FIGS. 12–14. However, the embodiment shown in FIGS. 15 and 16 employs single-piece (integral) contacts, i.e., contacts where the contacts 9a, 9b, 9c each form a single piece with the appropriate termination legs 121, 122, 123. It should be noted that the integral design may also be used in the embodiments adapted for parallel mounting.

It is clear that the exit or the type of "lead-out" of the contacts for the perpendicular mounting shown in FIGS. 15 and 16 is substantially similar to the type of "lead-out" shown for the embodiment of FIGS. 7 and 8, with the exception that in FIGS. 7 and 8 also the contacting of the lower surface of the circuit board 2 is disclosed.

Figure 17:
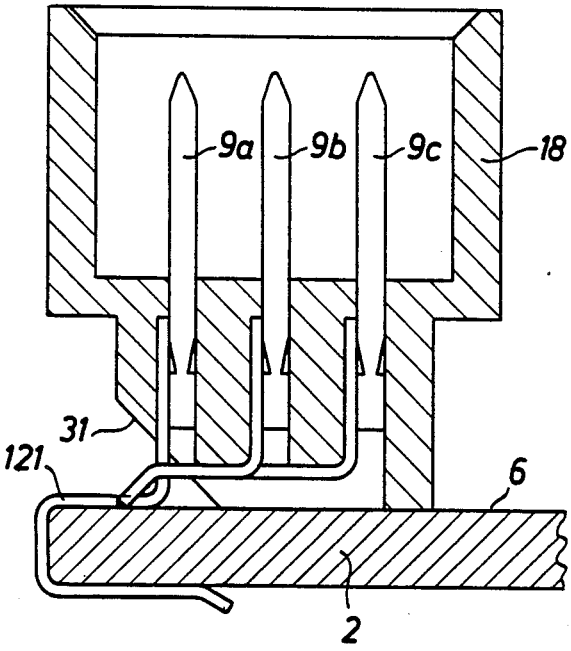

FIG. 17 discloses an embodiment according to which the contacting of the bottom surface of the circuit board is also shown for the perpendicular mounting approach. The contacting of the bottom surface is shown for termination leg 121.

According to the present invention, a connector is disclosed which is adapted to be mounted on a surface, in particular the surface of a circuit board. The connector of the invention does not require through-holes or bores in the circuit board for receiving the termination legs of the contacts. The connector of the invention can be used with all common soldering methods. By arranging the soldering pads 7 on the circuit board in a single row, the invention makes it possible that a minimum amount of space is required for the connector. Also, the formation of shadows in case of the wave-soldering method is avoided. Together with the connector of the invention, it is also possible to use the reflow soldering technique, the vapor-phase soldering technique as well as the wave-soldering technique.

It should be noted that the basis for the so-called surface-mounted device approach are compenents without termination wires. According to the SMD-technique, the miniaturized active and passive components are directly mounted onto the surface of circuit board or ceramic substrates. In contrast to the circuit board technique using bores and components with wires, the SMD-technique provides for a saving of space up to 70%. The special problems occurring with connectors in the SMD-technique are solved by the present invention.

Summing up the invention, the following can be said.

A connector adapted to be surface-mounted on a circuit board is provided. The free ends (soldering ends) of the termination legs (contact legs) of the contacts are led out of the connector in a single-row manner. The soldering ends are preferably placed on the line of section of the two possible circuit board-mounting planes (perpendicular mounting and parallel mounting). For a three-row connector, the soldering ends are spaced with a third of the spacing "t". In accordance with the invention, the same contacts and soldering ends may be used for the perpendicular mounting as well as the parallel mounting. The contacts may be of integral design or of a multi-part design. Due to the U-shaped design of the termination legs or the soldering ends present for one or more rows of contacts, both surfaces of the circuit board may be contacted.

I claim:

1. A connector adapted to be mounted on a printed circuit board, said connector comprising;

an elongated insulating body having a front mating end, a back terminating end and a longitudinal axis;

a plurality of contact elements mounted in said insulating body, said contact elements being arranged in at least three rows extending parallel to said longitudinal axis and being arranged in a plurality of lines extending substantially perpendicularly to said rows, each of said contact elements having a connecting end adjacent to said front end of said body, and a termination leg extending from said back end of said body, each of said termination legs ending in a free end which is adapted to contact a respective solder pad provided at a surface of said printed circuit board, said body having a supporting surface adapted to support said connector on a surface of said board when said connector is mounted parallel to said board, said supporting surface being located adjacent to a back portion of said body, said body having an exterior surface extending at a slanting angle from said supporting surface to said back end, so as to define a free space between said supporting surface and said back end, the free ends of said termination legs being located within said free space, said termination legs of said contacts in each line of contacts extending such that a first of said termination legs extends outwardly from said back end substantially along said line with its free end being located adjacent to a predetermined solder pad when said connector is mounted on said board, a second of said termination legs extends outwardly from said back end and extends laterally to one side of said first of said termination legs, with the free end of said second of said termination legs being located adjacent to a second solder pad located in line with and on one side of said predetermined solder pad, and a third of said terminating legs extends outwardly from said back end and extends laterally to the other side of said first of said termination legs, with the free end of said third of said termination legs being located adjacent to a third solder pad located in line with and on an opposite side of said predetermined solder pad, said free ends of said first, second and third termination legs being arranged adjacent to each other on a line extending substantially parallel to said longitudinal axis, and means on said connector permitting said connector to be mounted either parallel to or perpendicular to said board to change the orientation of the connecting ends of the contact elements by substantially 90 degrees.

2. The connector of claim 1, wherein said exterior surface is shaped so that said space has a cross-section in the form of a right triangle.

3. The connector of claim 1, wherein said termination legs are integral with said connecting end of said contacts.

4. The connector of claims 1, wherein said first termination leg is located closest to said free space, said third termination leg being located the farthest from said free space and said second termination leg being located between said first and third termination legs.

5. The connector of claim 1, wherein said insulating body has curved extensions with reduced portions at opposite ends thereof such that access of solder material to the ends of said termination legs is improved, and said connector is adapted for mounting to said board by means of adhesive.

6. The connector of claim 1, wherein said termination legs and connecting ends are separate parts that are integrated together.

7. A connector adapted to be mounted on a printed circuit board, said connector comprising;

an elongated insulating body having a front mating end, a back terminating end and a longitudinal axis;

a plurality of contact elements mounted in said insulating body, said contact elements being arranged in at least three rows extending parallel to said longitudinal axis and being arranged in a plurality of lines extending substantially perpendicularly to said rows.

each of said contact elements having a connecting end adjacent to said front end of said body, and a termination leg extending from said back end of said body, each of said termination legs ending in a free end which is adapted to contact a surface of said printed circuit board, said body having a supporting surface adapted to support said connector on a surface of said board when said connector is mounted parallel to said board, said supporting surface being located adjacent to a back portion of said body, said body having an exterior surface extending at a slanting angle from said supporting surface to said back end, so as to define a free space between said supporting surface and said back end, said termination legs of said contacts in each line of contacts extending such that a first of said termination legs extends outwardly from said back end and includes at least one U-shaped portion, with its free end being located adjacent to a first side of said board when said connector is mounted to said board, a second of said termination legs extends outwardly from said back end and is formed such that its free end extends adjacent to a first solder pad on a second side of said board, and said third of said termination legs extends outwardly from said back end and is formed such that its free end is located adjacent to a second solder pad located in line with and adjacent to said first solder pad on said second surface, said free ends of said second and third termination legs being arranged on a line extending substantially parallel to said longitudinal axis, and the free ends of said second and third termination legs being located within said free space.

8. The connector of claim 7, wherein said first of said termination legs is adapted to extend over an edge of said board.

9. The connector of claim 8, wherein said first of said termination legs extends initially into said free space and includes two U-shaped portions.

10. The connector of claim 8, wherein said first of said termination legs includes a single U-shaped portion.

* * * * *